US006578248B1

(12) United States Patent
Boldizar

(10) Patent No.: US 6,578,248 B1
(45) Date of Patent: Jun. 17, 2003

(54) VEHICLE WINDOW SUPPORT TOOL

(76) Inventor: Laslo L. Boldizar, P.O. Box 2456, Acton, MA (US) 01720

( * ) Notice: Subject to any disclaimer, the term of this patent is extended or adjusted under 35 U.S.C. 154(b) by 601 days.

(21) Appl. No.: 08/964,496

(22) Filed: Nov. 5, 1997

(51) Int. Cl.[7] ..... B25B 27/14
(52) U.S. Cl. ..... 29/281.5; 269/21
(58) Field of Search ..... 29/281.6, 281.5; 248/206.2, 206.3, 309.3; 269/21

(56) References Cited

U.S. PATENT DOCUMENTS 5,398,602 A * 3/1995 Taylor ..... 248/206.3

* cited by examiner

*Primary Examiner*—Lee Wilson
(74) *Attorney, Agent, or Firm*—Kenneth L. Milik

(57) ABSTRACT

A window support apparatus positively supports a glass panel of an automobile side window in its upward or closed position while disconnected from its supporting window regulator mechanism. The support apparatus includes a support frame, a pair of suction cups for clamping the apparatus to the window glass, and a pair of slides which fit in the window channel of the door between the glass panel and the exterior or interior door panel. The window support apparatus opposes sudden downward movement of the window glass panel resulting from gravity, and is removably installed on the automobile door to prevent inadvertent falling of the glass panel into the door cavity while repair work is performed on the door or the door's interior components.

16 Claims, 8 Drawing Sheets

VEHICLE WINDOW SUPPORT TOOL

FIELD OF THE INVENTION

The present invention relates generally to an apparatus for preventing undesired motion of free-moving member in a support track, and more particularly to a safety tool for preventing falling movement of an automobile window which has been disengaged from its normally attached window-height regulator.

BACKGROUND OF THE INVENTION

In modern automobiles, the side doors contain increasingly complex mechanical, electromechanical, and electrical subsystems. For example, the interior cavity of the door between the exterior door panel and interior door panel door will typically include several of the following components: a window glass panel; guide tracks for the glass panel; a power window regulator including an electric motor, switches, and wiring or, alternatively, a manual window regulator including a crank-type handle; mechanical linkages between the window regulator and glass panel; door handle and door lock mechanisms; speakers for the radio; electronic security sensors; and side-impact airbags.

The complexity of these components make it likely that maintenance and repair operations will need to be performed within the door cavity. Access to the door cavity is attained, generally, by removal of the interior door trim panel. With the trim panel removed, apertures in the interior door panel allow hand access to the components interior to the door cavity.

To repair windows or window-height regulators, to repair automobile body work, or to gain access to other components obscured behind the window glass panel and window-height regulator, it is often necessary to disengage the window glass panel from the window-height regulator, which normally regulates the height of the window glass panel and supports the glass panel for upward and downward movement.

Repair work interior to the door necessitates that the window glass panel be suspended in a fully upward position for extended periods of time. However, when disconnected from the window-height regulator, the window glass panel becomes essentially free-moving; that is, it is free to move downwardly and to fall into the door cavity. Typically, in this situation, a wedge is forced into the narrow channel between the window glass panel and the interior or exterior door panels to support the window glass panel in its upward position by friction and to prevent sudden downward movement of the glass panel.

However, wedges as described have a tendency to slip or pop out of the channel, due to vibration of the door. Suddenly, without warning, the window glass panel may drop into the door cavity and present a severe safety hazard to persons performing repairs. The glass panel can fall with sufficient speed and force to create what may be called "a guillotine effect," which can seriously injure the fingers and hands of an operator performing repairs to the interior of the door.

SUMMARY OF THE INVENTION

Accordingly, it is an object of the present invention to provide a window support tool that overcomes many of the disadvantages of the prior art methods of supporting a free-moving window glass panel to prevent sudden, undesired downward movement.

It is another object of the present invention to provide a simple to install tool that reliably holds a disengaged automobile side window in place so that repair work interior to the automobile door may be conducted in relative safety.

It is yet another object of the present invention to provide a window support tool which is low cost and simple to manufacture.

It is still another object of the present invention to provide a window support tool which which is not easily dislodged by jarring and vibration to provide an improved degree of safety to an operator working on the interior of a vehicle door. Finally, it is a related object of the present invention to provide a window support tool which can function reliably for extended time periods to provide operator safety during long and complex repair operations interior to the door panels.

In accordance with the preferred embodiment of the present invention, a window support tool is provided for supporting a vehicle door window, particularly in an automobile side door. The present invention is an inexpensive safety-related tool, which is utilized in the repair of automobile door panels. The present invention provides a means for supporting an automobile side window when the window-height regulator and cranking mechanisms inside the door panels have been disconnected from the window glass panel, as during a repair operation interior to the door.

This tool reliably supports the disconnected automobile window in its upward position for the time periods required to repair internal door mechanisms. The tool includes a horizontal support frame; first and second suction cups, mounted on the support frame in a spaced arrangement, for removably clamping the tool to the window glass panel; and first and second slides, also mounted on the frame in a spaced arrangement, for inserting a predetermined distance into the window channel between the glass panel and one of said door panels. In the preferred embodiment, the slides have an inverted L-shape and a tapered section to facilitate insertion into the window channel. The slides will insert into the window channel a predetermined distance and no more. When installed, the suction cups securely clamped to the window glass panel and the slides in the window channel cooperate to evenly support the glass panel in its uppermost position and prevent sudden downward movement of the glass panel.

The tool may be utilized on either side of the window and various low cost materials may be utilized in the manufacture of this device.

BRIEF DESCRIPTION OF THE DRAWINGS

The foregoing and other objects, features and advantages of the invention will be apparent from the following more particular description of a preferred embodiment of the invention, in conjunction with the accompanying drawings. In the drawings.

DESCRIPTION OF THE PREFERRED EMBODIMENTS

Figure 1:
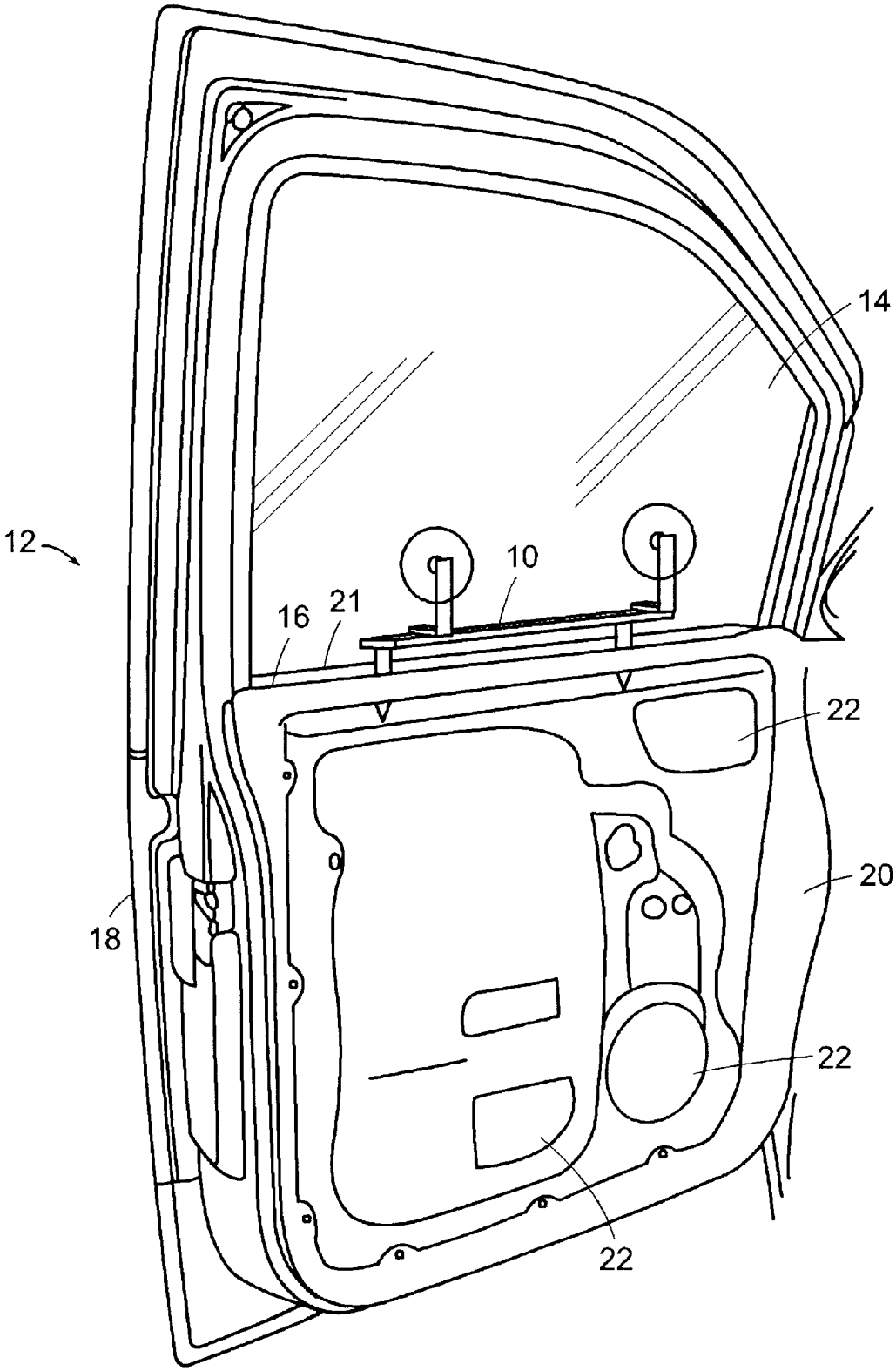
FIG. 1 is a perspective view of an automobile side door, showing its major components and the window support tool of the present invention installed on the interior side of the door.

Referring now to FIG. 1, a vehicle window support tool 10 is show in accordance with the present invention. In the figure, the window support tool 10 is installed for proper functioning on the interior side of an automobile door 12. It should be appreciated that the present invention may be used with any vehicle window having a glass panel 14, including tailgate windows on what are commonly knows as sport utility vehicles.

The vehicle window support tool 10 functions to hold the vehicle window glass panel 14 window in a predetermined, secure, stationary position when the window glass panel 14 is disengaged from its normally attached regulator mechanism or other supporting structures, especially during repair operations to the interior of the automobile door 12 for extended periods of time. The functioning of the window support tool 10 will be described in more detail further on.

Figure 2:
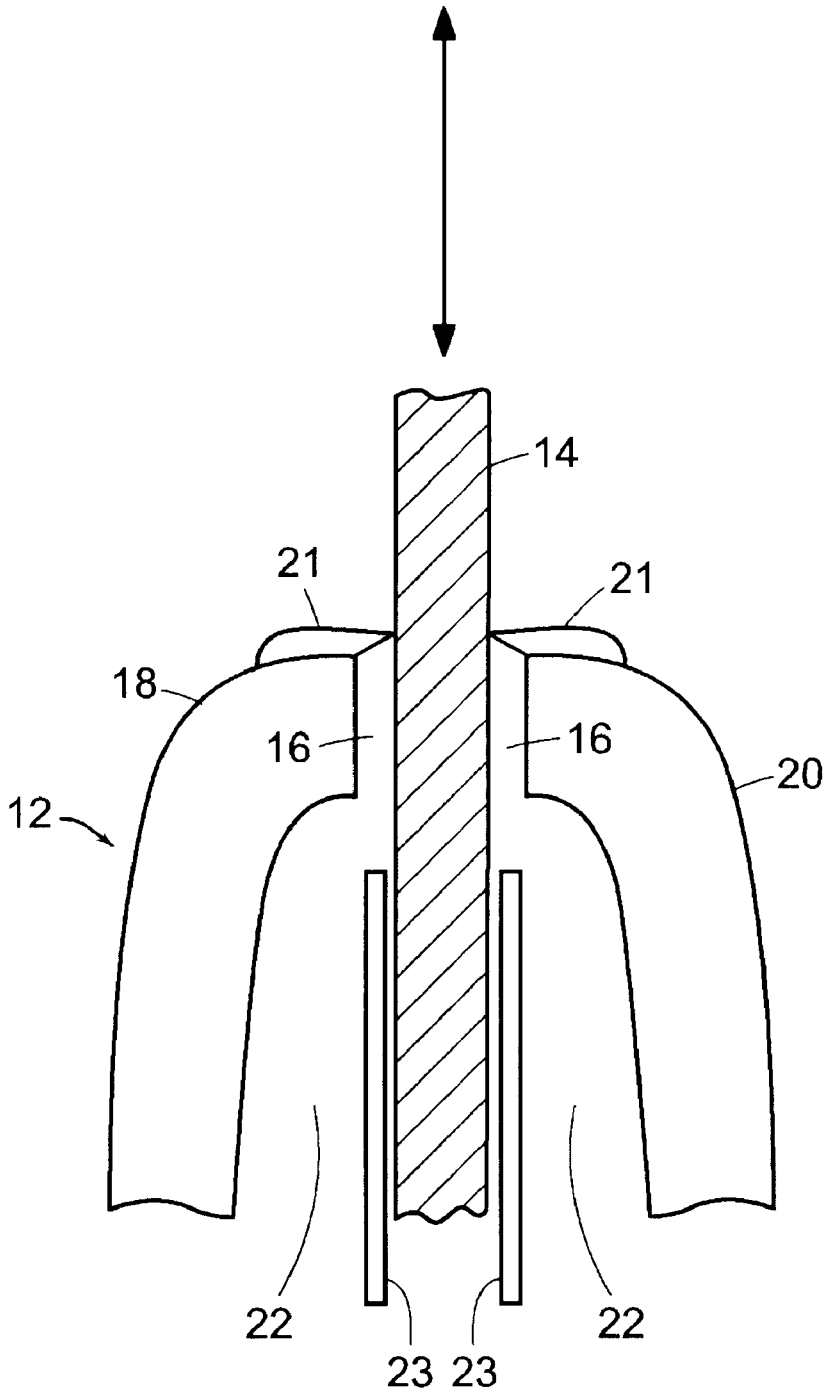
FIG. 2 is a schematic illustration of a portion of an automobile side door, showing the relationship of the window glass panel to other elements.

The automobile side door 12 shown in FIG. 1 and schematically in FIG. 2, includes several elements typical of those included in all vehicle door structures.

The glass panel 14 is disposed for free-moving vertical movement in a linear window channel 16 which is formed at a juncture between an exterior door panel 18 and an interior door panel 20. In modern streamlined vehicles, the glass panel 14 will normally include a radius of curvature to conform to the shape of the vehicle body. However, in FIG. 2, for simplicity, the glass panel 14 is shown without such curvature. The glass panel 14 moves downwardly and upwardly in the window channel 16 to effect opening or closing of the vehicle window. Weather stripping 21 in the form of flexible rubber strips affixed to the exterior door panel 18 and the interior door panel 20 along each edge of the window channel 16 prevents rainwater, dirt, or other foreign material from entering the window channel 16 while providing minimal frictional resistance to window movement.

When the window is fully opened, the glass panel 14 is mostly recessed in the door cavity 22, which is the space enclosed between the exterior door panel 18 and the interior door panel 20. The glass panel 14 is supported in the door cavity 22 by window tracks or guides 23 which insure that the window moves along a predetermined pathway without binding in the window channel 16. The top edge of the glass panel 14 maintains a generally parallel relationship with the plane of the window channel 16 as the glass panel 14 moves upwardly or downwardly.

The door cavity 22 includes several elements not shown in the figures and forming no part of the present invention. The interior side of the door includes an interior trim panel which has been removed in FIG. 1. With the trim panel removed, access to the door cavity is typically provided by a number of apertures in the interior door panel.

The door cavity 22 includes a window-height regulator for controlling the roll-up height of the glass panel 14; that is, the degree to which the window is opened or closed. Window-height regulators are of two types: power regulators that are actuated by an electric motor, or manual regulators, which are actuated by a roll-up crank and handle. Power-window regulators will also including electrical switches and wiring.

The window-height regulator is connected by mechanical linkage to the lower edge of the glass panel 14 or a rail fixed thereto to support the glass panel 14 for upward or downward movement.

Furthermore, the door cavity 22 typically includes a door handle and door lock mechanisms, speakers for the radio, and possibly electronic security sensors.

Any of the elements thus far described housed within the door cavity 22, including the glass panel 14 itself, may require adjustment, replacement, or repair. To facilitate this adjustment, replacement, or repair, the glass panel 14 is often detached from the window regulator mechanism to provide more ready access to the door cavity 22. During the repair process it is advantageous for the glass panel 14 to be placed in the fully upward position, so that it will not obstruct access to any parts of the door cavity 22. When detached from the regulator mechanism, the glass panel 14 is in a free-moving state; that is, the glass panel is capable of unimpeded upward or downward movement. In the free-moving state, under the force of gravity, the glass panel 14 can fall at substantial speed and with substantial force, presenting the danger of injury to an operator whose hands are within the door cavity 22 performing repair operations.

The window support tool 10 holds the glass panel 14 in an upward position reliably for extended periods of time, so that the window does not suddenly become dislodged and fall down into the door cavity with high speed to cause injury to the person performing the repair to the door.

Figure 3:
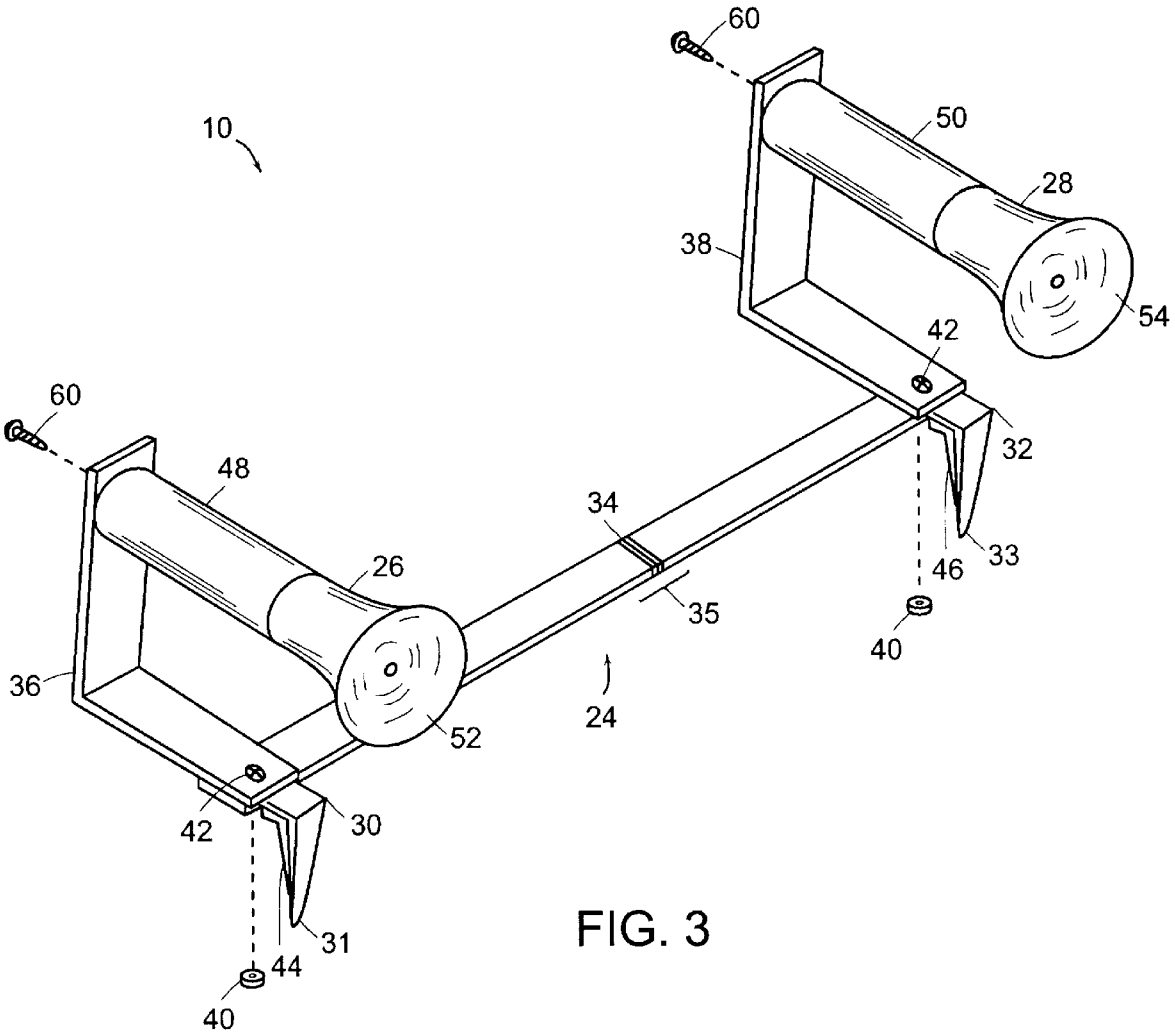
FIG. 3 is a perspective view of the window support tool of the present invention.
Figure 4:
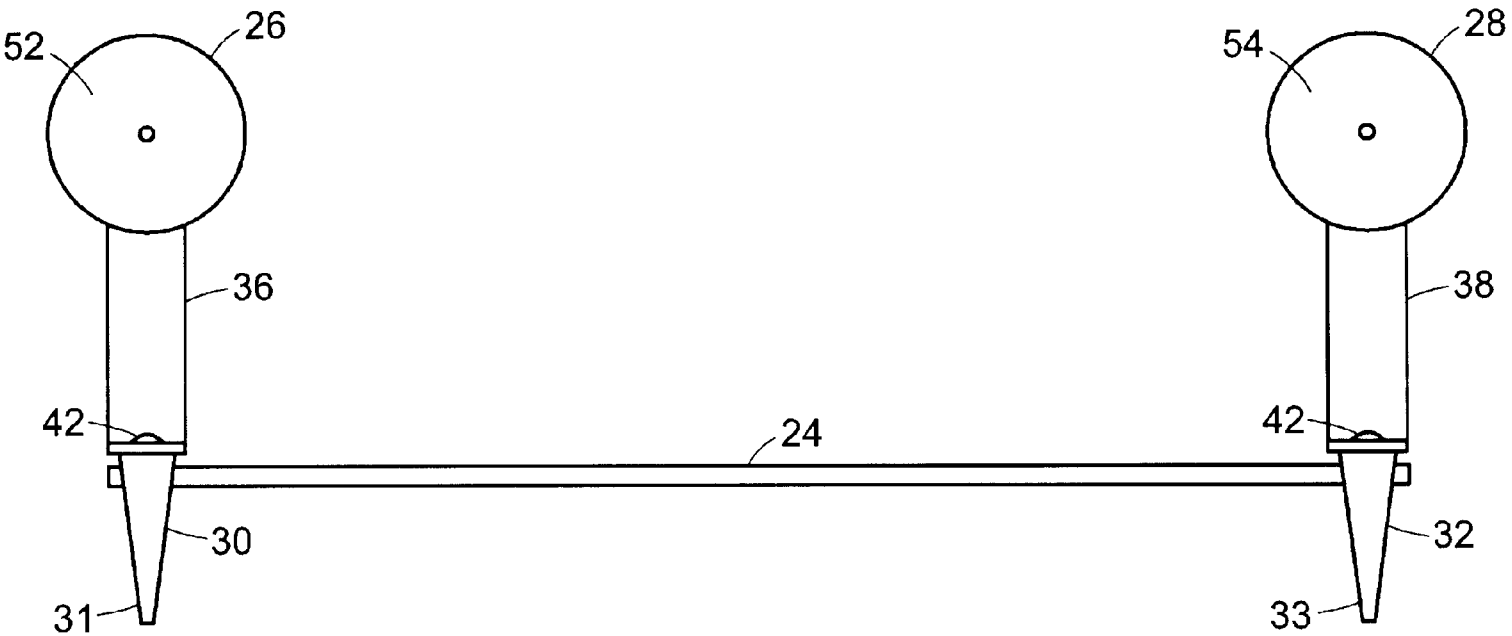
FIG. 4 is a front plan view of the window support tool of the present invention.
Figure 5:
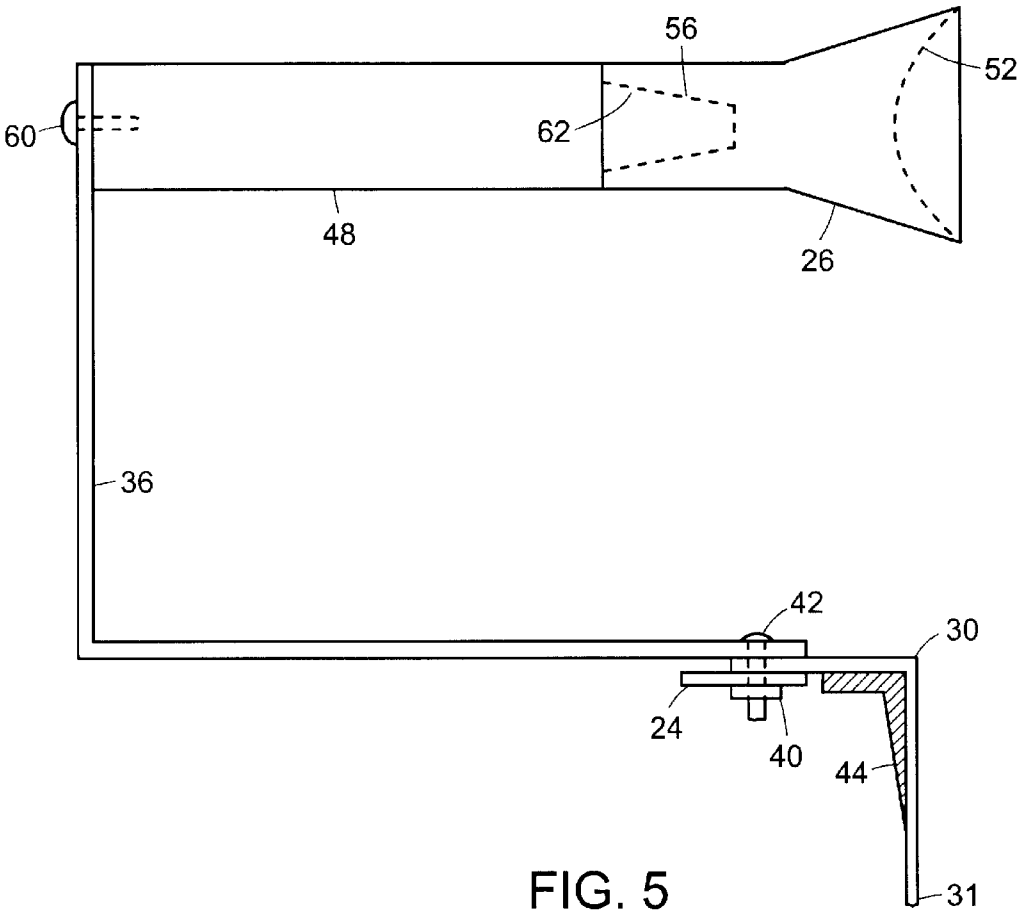
FIG. 5 is a left side plan view of the window support apparatus.

Turning now to FIGS. 3 through 5, the structure of the window support tool 10 is shown in more detail. The window support tool 10 includes, as its main functional elements, a frame 24, first and second suction cups 26 and 28, and first and second slides 30 and 32.

The frame 24 supports the operational elements of the tool 10 in a fixed orientation for proper functioning. The frame 24 includes a lateral cross member 34, and two L-shaped brackets 36 and 38 at its distal ends. In the preferred embodiment, the frame 24 is constructed of separate steel elements, although it is contemplated that wood and also plastic components may be used. The cross member 34 and L-shaped brackets 36 and 38 are joined by a nut 40 and bolt 42 to create a rigid mounting for the other elements. Also, it is contemplated that the cross member 34 and L-shaped brackets 36 and 38 may preferably be molded from durable plastic as a single low-cost element.

In the preferred embodiment, the cross member 34 has a length of eleven inches, although other lengths may be used. The length provides adequate separation of the suction cups 26 and 28 and of the slides 30 and 32 to support the glass panel 14 evenly and prevent it from rotating within the window channel 16. The length of the cross member 34 was chosen to accommodate glass panels 14 of various widths as would be found in different vehicles, while not making the overall size of the tool unwieldy.

It is also contemplated that the window support tool 10 may include an adjustable feature 35, so that the separation distance of the suction cups 26 and 28 and of the slides 30 and 32 could be optimally chosen for the particular window glass panel 14 being supported. This adjustable-tool-width feature can be implemented by substituting a two-element overlapping or telescoping cross member 35 for the single cross member 34 in the preferred embodiment. The operator could then choose any width setting within a predefined range.

The first and second slides 30 and 32 are inverted L-shaped members mounted to the front-most part of the frame 24 its distal ends by the nuts 40 and bolts 42. The slides 30 and 32 include tapered sections 31 and 33, each having a width dimension that gradually narrows to a point. The slides 30 and 32 are mounted on the frame 24 so the tapered sections 31 and 33 point downwardly with respect to the support tool 10.

The shape and orientation of the slides 30 and 32 provide for easy installation of the tool with the tapered sections 31 and 33 readily fitting in the window channel 16 between the glass panel 14 and either the exterior door panel 18 or the interior door panel 20. The length of the tapered sections 31 and 33 are sufficiently long so that the slides 31 and 32 will not accidently disengage from the window channel 16 due to bumping, jarring, or vibration. In the preferred embodiment, the tapered sections 31 and 33 are 1.5 inches in length.

Functionally, the slides orient the support tool 10 evenly against the glass panel 14 and support the weight of the glass panel 14 against the exterior door panel 18 or interior door panel 20 when the tool 10 is in use. The weight of the glass panel 14 is evenly distributed between the two slides.

The slides 30 and 32 are fabricated from steel. Rubber pads 44 and 46 are mounted to the undersides of the slides 30 and 32 to prevent marring of the exterior door panel 18 or interior door panel 20 at the points where the support tool 10 contacts the vehicle door 12. The rubber pads 44 and 46 are shaped to fit the undersides of the slides 30 and 32 and have a thickness which exceeds that of the cross member 34 to prevent said marring. The rubber pads 44 and 46 are attached to the slides 30 and 32 by glue or other suitable adhesive. It is contemplated that the slides may be fabricated from plastic, which would eliminate the need for the rubber pads 44 and 46.

The suction cups 26 and 28 will now be described in connection with FIGS. 3 through 6. Similar to the slides 30 and 32, the suction cups 26 and 28 are mounted on the distal ends of the frame 24 in a generally parallel configuration. With the suction cups 26 and 28 properly mounted on the frame 24, the support tool 10 is configured so as to align the suction cups 26 and 28 for contact with the glass panel 14 when the slides 30 and 32 of the support tool 10 are inserted into the window channel 16, as previously described.

In order to achieve this proper configuration of elements, the suction cups 26 and 28 are mounted on cylindrical extensions 48 and 50, which function to extend the suction cups 26 and 28 forward, from the L-shaped brackets 36 and 38, so that the cup-shape ends of the suction cups 26 and 28 project marginally beyond the front-most portions of the slides 30 and 32.

The suction cups 26 and 28 are conventional in structure and function and include a flared portion made of resilient rubber enclosing concave cavities 52 and 54. In the preferred embodiment, the suction cups 26 and 28 are 1.25-inch Pick & Place Cups manufactured by Wood's Power Grip of Laurel, Montana. When the suction cups 26 and 28 are pressed against the glass panel 14, a partial vacuum is created within the concave cavities 52 and 54, achieving a firm but removable attachment to the glass panel 14. The suction cups 26 and 28 thus provide a clamping function, when applied to the window glass panel 14. In the preferred embodiment, the suction cups have a rated lifting capacity of three pounds, which is more than sufficient to support the weight of a typical window glass panel 14. Furthermore, the dual suction cup arrangement provides a level of redundancy. If one of the suction cups 26 and 28 were inadvertently dislodged from the glass panel, the second suction cup would provide enough clamping force to allow the invention to achieve its objective of preventing the glass panel 14 from suddenly falling into the door cavity 22. The suction cups 26 and 28 include recesses 56 and 58 for mounting onto a post as will now be described.

Figure 6:
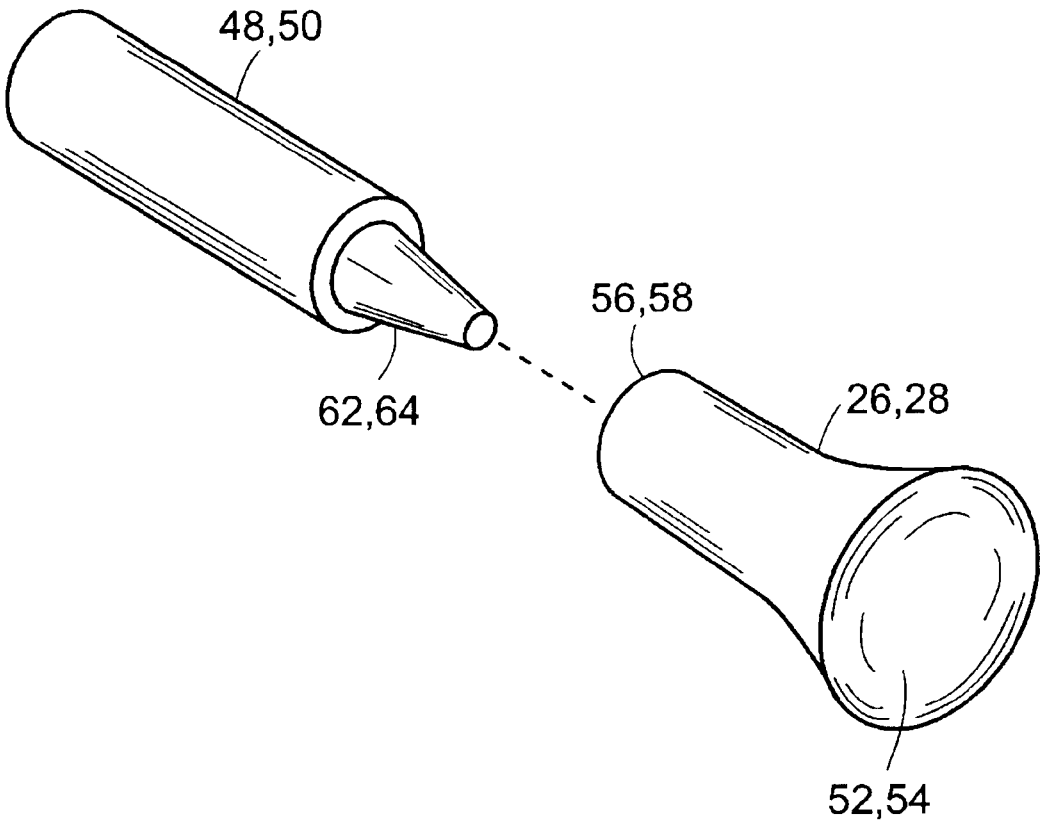
FIG. 6 is a perspective view of an extension and suction cup, showing their components and proper assembly.

Turning to FIG. 5 and particularly to FIG. 6, the interrelationship between the extensions 48 and 50 and the suction cups 26 and 28 is shown in more detail. The extensions 48 and 50 are attached to the L-shaped brackets 36 and 38 by fastening screws 60. The extensions 48 and 50 are basically cylinders of a predetermined length that function as spacers. The diameters of the extensions 48 and 50 match those of the base (non-flared) portions of the suction cups 26 and 28, primarily for aesthetic reasons. The extensions 48 and 50 are tapped at one end for receiving the fastening screws 60. The opposite ends of the extensions 48 and 50 include protruding tips 62 and 64, which have a decreased diameter and are sized for press fitting into the recesses 56 and 58 of the suction cups.

Figure 7:
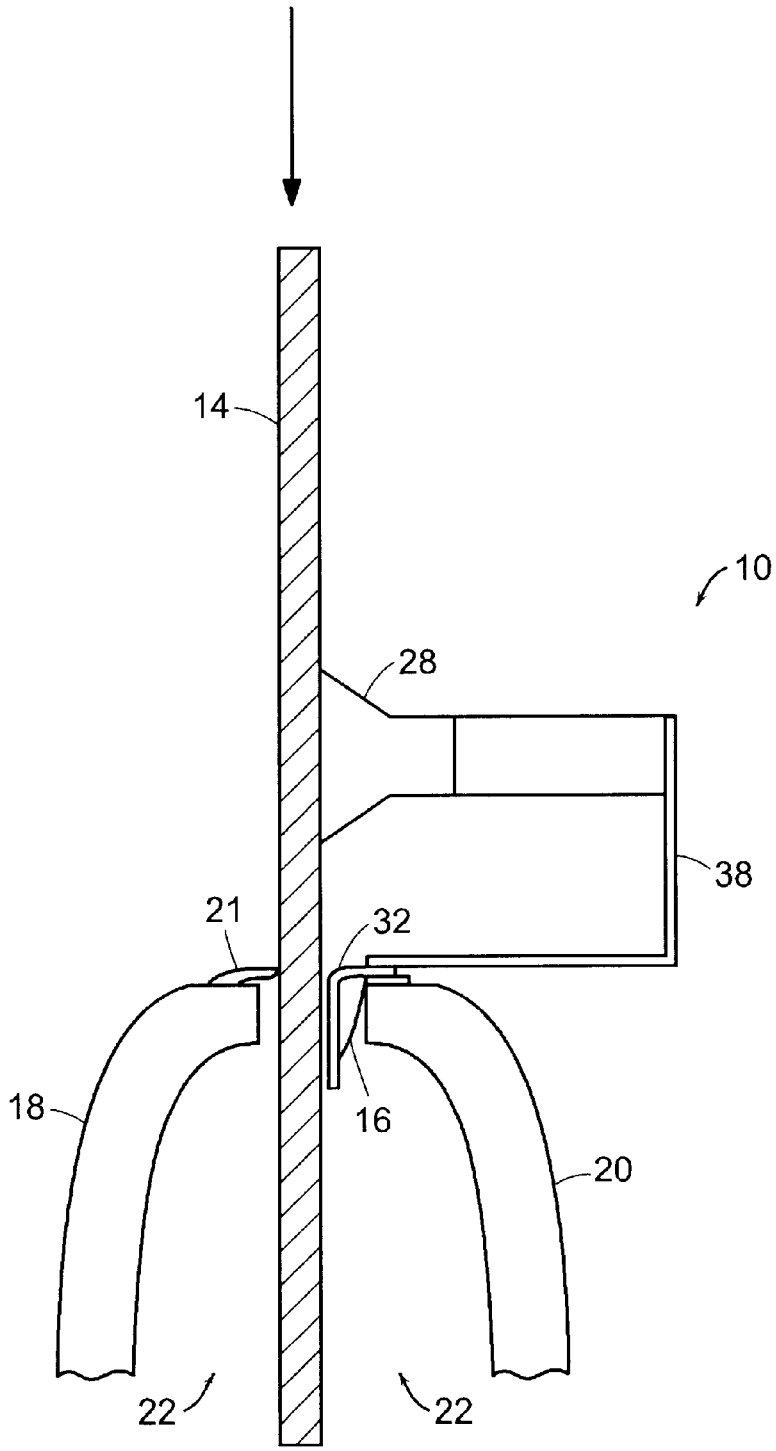
FIG. 7 is a schematic illustration of a portion of an automobile side door, showing the window support tool of the present invention installed on the interior side of the door.

The use of the present invention will now be described with particular reference to FIG. 7. Initially, the automobile side window glass panel 14 must be raised to its fully upward position, although the present invention may be used effectively if the automobile side window is only partially in the upright position. In operation, the window support tool 10 is preferably installed on either the exterior door panel 18 or interior door panel 20 prior to commencement of repair work related to a vehicle door 12. The window support tool 10 of the present invention works equally well when used on either the inside or outside of the vehicle door 12, and the choice will generally be a matter of convenience to the user. To perform its intended function, the window support tool 10 must be installed prior to disconnecting the regulator mechanism from the window glass panel 14.

For installation, the window support tool 10 may be gripped by the L-shaped brackets 36 and 38 which, do to the preferred configuration of the frame 24, provides a convenient handgrip for aligning, installing, and removing the support tool 10.

With the support tool oriented so that the suction cups 26 and 28 are upward and the slides 30 and 32 face downward, the user carefully pushes the tapered members 31 and 33 past the weather stripping 21 and into the window channel between the glass panel 14 and the door panel 20. Then, pressure is applied to the upper portion of the window support tool 10 to momentarily compress the suction cups 26 and 28 against the glass panel 14 sufficiently to create a partial vacuum in the cavities 52 and 54, clamping the suction cups 26 and 28 firmly to the glass panel 14. Alternatively, the suction cups 26 and 28 may be pressed onto the glass panel 14 sequentially rather than simultaneously to provide a positive attachment of the window support tool 10 to the glass panel 14. The slides 30 and 32, being significantly wider than the window channel 16, rest on the exterior door panel 18 or interior door panel 20 and support the weight of the glass panel 14 through the frame 24.

Once installed as described above, the window glass panel 14 is securely held in its fully upward or partially upward position. The window is positively held by the window support tool 10 so that it can not become easily dislodged, if for instance, it is accidently bumped. The window support tool 10 will also not be dislodged by vibration, and will provide positive support for the window over a continuous time interval sufficient for most repair operations to be performed inside the door cavity 22.

As stated earlier, conventional or improvised wedges have a tendency to dislodge naturally over time due to vibration of the door 12 during the repair operation of the door 12 and by accidental banging of the improvised wedge itself. Conventionally, therefore, the operator must continually check the setting of the wedge, while being fearful that the wedge may pop out and the glass panel 14 may suddenly fall downwardly to cause hand injury. The drawbacks of conventional wedges reduce the efficiency of the repair operations.

The present invention eliminates these dangers and contributes to increased efficiency of the repair operation. The support tool 10 holds the glass panel 14 in place reliably for the long time periods needed to effect repairs on the interior of the door 12. The positive locking of the window glass panel 14 in the upward position, insures that a person may work within the door cavity 22 calmly confident that the glass panel 14 will not crash down without warning to cause injury to the fingers or hands of the person working on the door 12. Therefore, use of the present window support tool 10 provides improved efficiency for the repair person by allowing uninterrupted concentration on the repair work itself.

In view of the above, it will be seen that the several objects of the present invention are readily achieved and other advantageous results attained.

Obviously many modifications and variations of the present invention are possible in light of the above teachings, without departing from the spirit and scope of the invention. For example, although the preferred embodiment of the invention teaches the use of two suction cups and two slides, it is contemplated that support tools may be constructed with varying numbers of suction cups and slides. Structures having at least one slide and at least once suction cup are within the scope of the present invention and claims.

As discussed above, the frame 24 of the present invention may be constructed as a single molded plastic piece. Conceivably, the entire tool—including the frame, suction cups, and slides—could be molded or cast as a single piece from materials having the proper durability, resiliency, and flexibility. Also, an alternative clamping means might be substituted for the suction cups and are within the scope of the present invention. Various adhesive compounds may provide an alternative to the suction cups, or the frame 24 could include C-clamps of a particular design that lock onto the upper edge of the window glass panel 14 to provide the needed clamping function.

Figure 8:
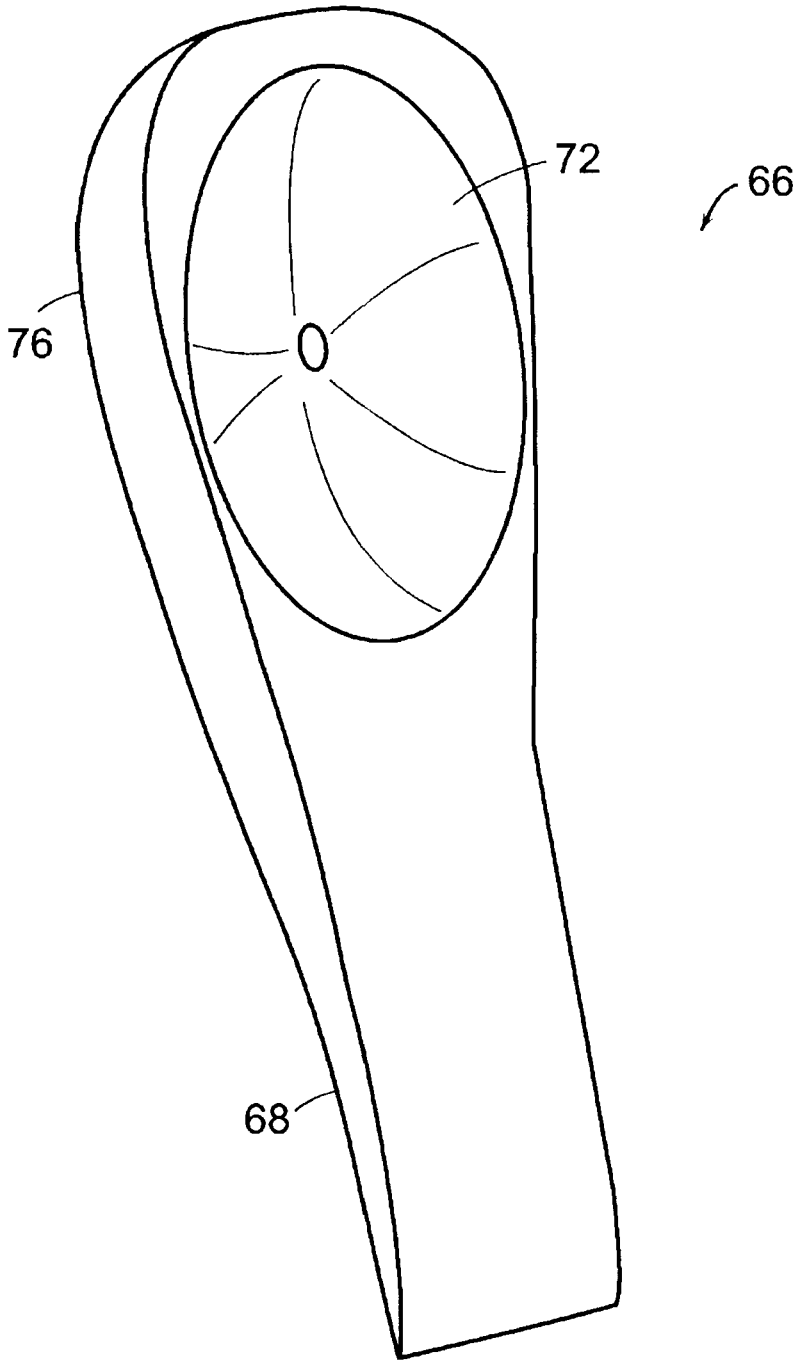
FIG. 8 is a perspective view of an alternative embodiment of the present invention.

Furthermore, the present invention could be fabricated as a single suction cup and slide combination, as illustrated in FIG. 8, and thus in use, a single device, or two or multiple support tools 66 may be used in parallel to increase the positive holding action, cumulatively as needed, to support a glass panel 14. In the figure, a support tool 66 includes a lower slide portion 68 and an upper head portion 70 which includes an integral suction cup 72. It is contemplated that the support tool 66 may be fabricated as a single component from hard rubber or other resilient compounds. Also, as shown in FIG. 8, the slide is shaped to function as a wedge to provide additional support functionality. These various embodiments come within the scope of the present invention.

The inventor's preferred embodiments, which are described in detail herein, are exemplary of all possible embodiments which practice the spirit of the present invention. The discussion of these embodiments should not be construed as limiting the scope of the appended claims.

In view of this, it is understood that the above description is illustrative rather than limiting.

What is claimed is:

1. A tool for supporting and preventing sudden downward movement of a vehicle door window, the window including a glass panel disposed for free-moving vertical movement in a window channel bounded by inner and outer door panels, the window tool comprising a frame, first and second suction cups, mounted on the support frame in a spaced arrangement, for removably clamping the tool to the window glass panel; and first and second slides, mounted on the frame in a spaced arrangement, for inserting a predetermined distance into the window channel between the glass panel and one of said door panels;

wherein the first and second suction cups, clamped to the window panel, cooperate with the slides, inserted into the window channel, and with the frame, to evenly support and prevent sudden downward movement of the glass panel.

2. The tool of claim 1 wherein said first and second slides have an inverted L-shape.

3. The tool of claim 1, wherein the first and second slides have a tapered part to facilitate insertion into the window channel.

4. The tool of claim 1, wherein said frame is adjustable in width.

5. The tool of claim 4, wherein the frame includes a telescoping cross member.

6. The tool of claim 1, wherein the frame is molded from plastic.

7. The tool of claim 1, further including means for limiting the distance the first and second slides may be inserted into the window channel to said predetermined distance.

8. The tool of claim 1, wherein said first and second slides include rubber pads to prevent marring of said door.

9. A window-support tool for automobile door windows disposed for free-moving vertical movement in a linear channel in the automobile door, the tool comprising a tool frame having a longitudinal dimension;

a pair of spaced suction cups mounted on the frame for removably attaching the tool to the window glass panel; and a pair of slides, mounted on the frame, for engaging the linear channel;

wherein the window is evenly supported in the channel and prevented from sudden downward movement.

10. The tool of claim 9 wherein the slides have an inverted L-shape.

11. The tool of claim 9 wherein the slides have a tapered part to facilitate insertion into the window channel.

12. The window support tool of claim 9, wherein said tool frame is adjustable in width.

13. The window support tool of claim 12, wherein the tool frame includes a telescoping cross member.

14. The window support tool of claim 9, wherein the tool support frame is molded from plastic.

15. The window support tool of claim 9, further including means for preventing the slides from entered the window channel more that said predetermined distance.

16. The window support tool of claim 9, wherein the slides include rubber pads to prevent marring of said door.

* * * * *